US008511114B2

(12) United States Patent
Urban et al.

(10) Patent No.: US 8,511,114 B2
(45) Date of Patent: Aug. 20, 2013

(54) JEWELRY ITEM AND METHODS OF MAKING AND USING IT

(75) Inventors: David C. Urban, San Diego, CA (US); Michael Gianni Tristani, San Diego, CA (US)

(73) Assignees: David C. Urban, San Diego, CA (US); Michael Gianni Tristani, San Diego, CA (US)

( * ) Notice: Subject to any disclaimer, the term of this patent is extended or adjusted under 35 U.S.C. 154(b) by 223 days.

(21) Appl. No.: 12/582,636

(22) Filed: Oct. 20, 2009

(65) Prior Publication Data

US 2011/0088428 A1 Apr. 21, 2011

(51) Int. Cl.
*A44C 25/00* (2006.01)

(52) U.S. Cl.
USPC ..... 63/33; 24/3.13; 2/244

(58) Field of Classification Search
USPC ..... 63/12, 13, 21, 23, 33, 3.1, 3.2, 1.11, 63/1.12, 1.13, 4; 351/52, 157–158; 132/275; 206/348; 24/3.13, 3.3, 3.12, 3.11, 3.6, 3.4; 224/220, 663, 667; 2/244
See application file for complete search history.

(56) References Cited

U.S. PATENT DOCUMENTS

| | | | | | |
|---|---|---|---|---|---|
| 77,587 | A | * | 5/1868 | Colborn | 24/116 A |
| 295,869 | A | * | 3/1884 | Herring | 63/21 |
| 296,542 | A | * | 4/1884 | Draper | 63/21 |
| 452,830 | A | * | 5/1891 | Bowie et al. | 224/220 |
| 633,092 | A | * | 9/1899 | Bigney | 63/21 |
| 781,629 | A | * | 2/1905 | Ahlstrom | 224/251 |
| 1,683,545 | A | * | 9/1928 | Harris | 63/1.15 |
| 1,720,472 | A | * | 7/1929 | Gagnon | 24/116 A |
| 1,797,456 | A | * | 3/1931 | Walker | 224/182 |
| 2,042,808 | A | * | 6/1936 | Seebeck | 24/3.13 |
| 2,125,362 | A | * | 8/1938 | Serihner | 24/3.13 |
| 2,224,721 | A | * | 12/1940 | Chernow | 59/80 |
| 2,260,700 | A | * | 10/1941 | Bloom et al. | 24/3.13 |
| 2,296,083 | A | * | 9/1942 | Bloom et al. | 24/3.13 |
| 2,296,084 | A | * | 9/1942 | Bloom et al. | 24/3.13 |
| 2,296,197 | A | * | 9/1942 | Bloom et al. | 24/3.13 |
| 2,297,661 | A | * | 9/1942 | Okun | 24/3.13 |
| 2,589,260 | A | * | 3/1952 | Jablon | 70/457 |
| 3,163,026 | A | * | 12/1964 | Kenny | 63/14.2 |
| 3,456,457 | A | * | 7/1969 | Cass | 63/33 |
| 4,527,316 | A | * | 7/1985 | Murphy | 24/616 |
| 5,070,581 | A | * | 12/1991 | Senter | 24/3.5 |
| 5,675,988 | A | * | 10/1997 | Ignatowski | 63/38 |
| 5,794,459 | A | * | 8/1998 | Ignatowski | 63/38 |
| 5,864,925 | A | * | 2/1999 | McGee | 24/3.11 |
| 5,934,123 | A | * | 8/1999 | Eldredge | 70/456 R |
| 6,026,515 | A | * | 2/2000 | Nielson et al. | 2/244 |
| 6,027,213 | A | * | 2/2000 | Ignatowski | 351/52 |
| 6,098,202 | A | * | 8/2000 | Peck | 2/244 |

(Continued)

*Primary Examiner* — Jack W Lavinder
*Assistant Examiner* — Abigail E Morrell
(74) *Attorney, Agent, or Firm* — Bernard L. Kleinke; Duckor Spradling Metzger & Wynne

(57) ABSTRACT

A jewelry item includes a chain, which has decorative items attached to it and which has a first fastening device to hang the item from an object such as a belt loop. A second fastening device is used to adjust the length of the object. Decorative items may be attached to the chain for providing an aesthetically pleasing appearance and for gathering together into a conglomeration to conceal the chain and providing a singular compact appearance for the jewelry item. A swivel coupled to the first fastening device permits the jewelry item to be rotated to an alternate viewing position.

5 Claims, 2 Drawing Sheets

(56) References Cited

U.S. PATENT DOCUMENTS

| | | | | |
|---|---|---|---|---|
| 6,138,356 | A * | 10/2000 | Hertelendy | 29/896.41 |
| 6,279,171 | B1 * | 8/2001 | Brancato | 2/326 |
| 6,302,814 | B1 * | 10/2001 | Cade | 473/594 |
| 6,520,635 | B1 * | 2/2003 | Ignatowski | 351/52 |
| 6,813,856 | B1 * | 11/2004 | Sitkewicz et al. | 43/42.15 |
| 6,862,838 | B1 * | 3/2005 | Gibbs | 43/44.98 |
| 6,863,394 | B1 * | 3/2005 | Nelson et al. | 351/52 |
| D525,558 | S * | 7/2006 | Dumas | D11/81 |
| 7,254,962 | B2 * | 8/2007 | Scharr | 63/40 |
| 7,322,214 | B2 * | 1/2008 | Ignatowski | 63/38 |
| 2002/0078707 | A1 * | 6/2002 | Walker et al. | 63/3.2 |
| 2003/0015213 | A1 * | 1/2003 | Sartena | 132/275 |
| 2003/0110798 | A1 * | 6/2003 | Ignatowski | 63/38 |
| 2004/0083636 | A1 * | 5/2004 | Cohn | 40/745 |
| 2004/0172735 | A1 * | 9/2004 | Garland | 2/160 |
| 2004/0216357 | A1 * | 11/2004 | Bobrowski | 43/42.06 |
| 2005/0232874 | A1 * | 10/2005 | Lipton et al. | 424/50 |
| 2005/0279136 | A1 * | 12/2005 | Bowman | 63/21 |

* cited by examiner

JEWELRY ITEM AND METHODS OF MAKING AND USING IT

FIELD OF THE INVENTION

The present invention relates in general to a jewelry item and methods of making and using it. It more particularly relates to a jewelry item and methods useful for displaying a plurality of decorative articles in an aesthetically pleasing manner.

BACKGROUND ART

There is no admission that the background art disclosed in this section legally constitutes prior art.

There are many types and kinds of jewelry items worn on a particular part of a person's body, such necklaces, watches, bracelets, rings, and ear rings, or worn attached to an article of clothing, such as pins, pocket watches with chains, wallet chains, and others. Thus, there are many different types and kinds of jewelry items for accessorizing a person's body as well as his or her wearing apparel.

For example, reference may be made to U.S. Pat. Nos. 6,026,515 and 6,098,202, and U.S. patent application publication 2005/0262874.

BRIEF DESCRIPTION OF THE DRAWINGS

The features of this invention and the manner of attaining them will become apparent, and the invention itself will be best understood by reference to the following description of certain embodiments of the invention taken in conjunction with the accompanying drawings, wherein.

DETAILED DESCRIPTION OF CERTAIN EMBODIMENTS OF THE INVENTION

Figure 1:
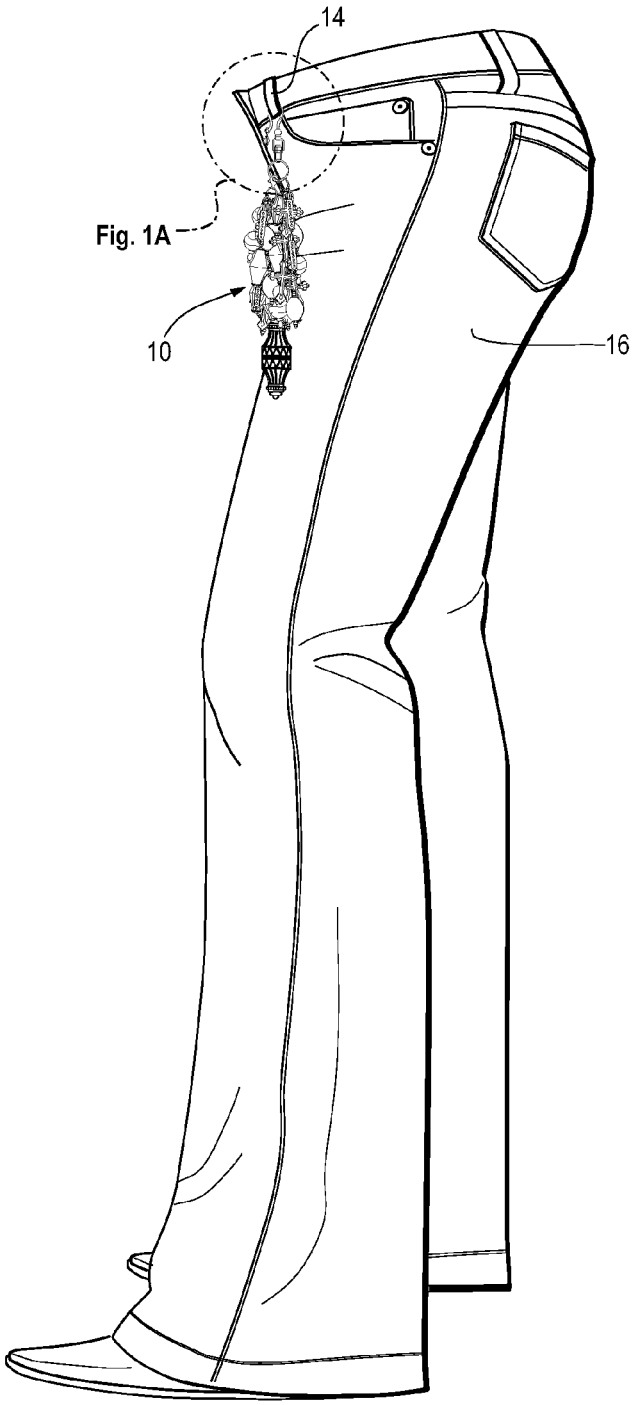
FIG. 1 is a pictorial view of a jewelry item constructed according to an embodiment of the invention, and being illustrated as being attached to a belt loop of a pair of jeans.

It will be readily understood that the components of the embodiments as generally described and illustrated in the drawings herein, could be arranged and designed in a wide variety of different configurations. Thus, the following more detailed description of the embodiments of the system, components and method of the present invention, as represented in the drawings, is not intended to limit the scope of the invention, as claimed, but is merely representative of the embodiments of the invention.

A jewelry item is disclosed and includes a chain, which has decorative items attached to it and which has a first fastening device to hang the item from an object such as a belt loop. A second fastening device is used to adjust the length of the object. Decorative items may be attached to the chain for providing an aesthetically pleasing appearance and for gathering together into a conglomeration to conceal the chain and providing a singular compact appearance for the jewelry item. A swivel coupled to the first fastening device permits the jewelry item to be rotated to an alternate viewing position.

There is disclosed a jewelry item and methods of making and using it. One embodiment of the jewelry item for attaching to an attachment point may include a first fastening device for quickly attaching and releasing the jewelry item from the point of attachment, a chain with a plurality of links and having a first end and a second end with the first end of the chain being coupled to the first fastening device, a plurality of decorative articles removably attached to the links of the chain, a swivel device being coupled between the first fastening device and the first end of the chain for permitting the chain to rotate relative to the first fastening device to expose a different view of the decorative articles, a ring being coupled between the swivel device and the first end of the chain, and a second fastening device being connected to the second end of the chain for releasably and selectively connecting to the ring or one of the links of the chain to form a closed loop of chain so that the length of the jewelry item can be adjusted. When the first fastening device is connected to the attachment point and the second fastening device is connected to the ring or one of the links of the chain to form a closed loop of chain, the jewelry item hangs therefrom and the decorative articles cluster together under the force of gravity to form an aesthetically pleasing conglomeration thereby substantially concealing the chain from view. When the first fastening device is connected to the attachment point and the second fastening device is not connected to form a closed loop of chain, the jewelry item hangs therefrom with the chain in a substantially vertical orientation and the decorative articles align together under the force of gravity to form an aesthetically pleasing linear configuration.

In accordance with yet another embodiment of the present invention, a method of making a jewelry item may include attaching a first fastening device to a first side of a swivel device, attaching a first end of a chain to a second side of the swivel device using a ring, attaching a second fastening device to a second end of the linear chain, and attaching a plurality of decorative articles to the loops of the linear chain. The first fastening device may allow a user to quickly and removably attach the jewelry item to an attachment point. The second fastening device may allow a user to adjust the length of the jewelry item by releasably attaching the second fastening device to the ring or one of the links of the chain to form a loop of chain.

The jewelry item basically may provide a loop of chain having attached to its links a plurality of decorative articles. The loop of chain and attached decorative articles may be hung by a hook-type device attached to a link of the chain and an attachment point so that under the force of gravity the two opposing sides of the loop of the chain hang nearly side-by-side in a substantially vertical manner. With the chain hanging in this manner, the decorative articles may be cluster together under the force of gravity to form an aesthetically pleasing conglomeration of decorative articles thereby substantially concealing the chain from view.

Figure 1A:
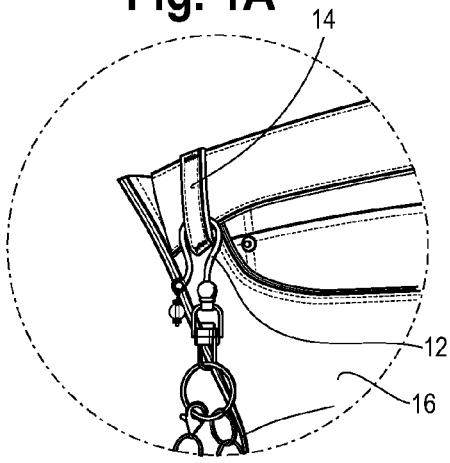
FIG. 1A is an enlarged view of the attachment point of the jewelry item with the belt loop of FIG. 1.
Figure 2:
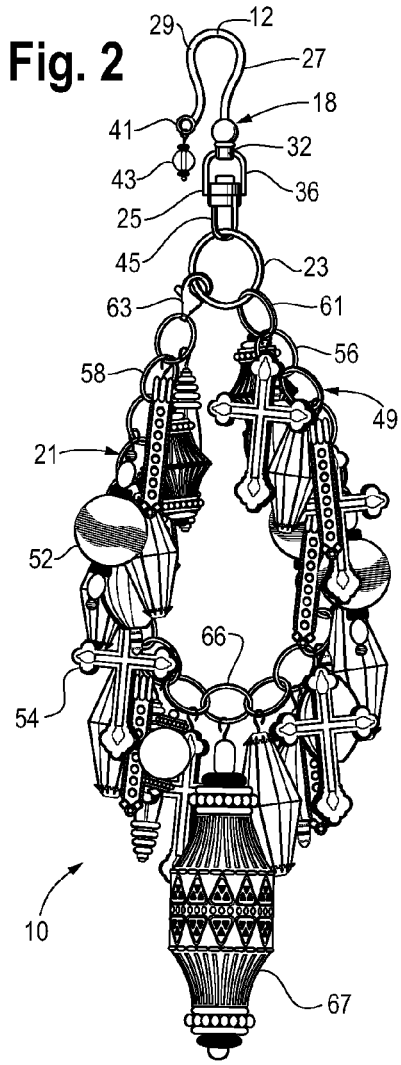
FIG. 2 is an enlarged front view of the jewelry item of FIG. 1 being illustrated with decorative articles being spread apart to reveal partially its chain.
Figure 3:
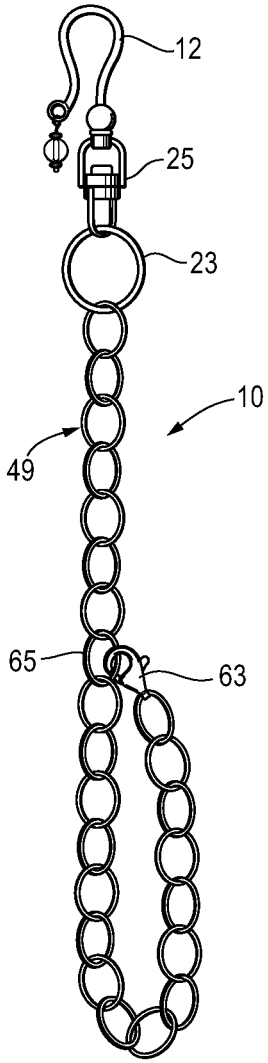
FIG. 3 is an enlarged front view of the jewelry item of FIG. 1 with its chain partially extended and the decorative articles being removed from the chain for illustration purposes.

Referring now to FIGS. 1 through 3 of the drawings, there is shown a jewelry item constructed in accordance with an embodiment of the present invention and is generally indicated at 10. As shown in FIGS. 1 and 1A, the jewelry item 10 may include a fastening device 12 for quickly and easily attaching and removing the jewelry item 10 from an attachment point, such as a belt loop 14 at the waist of wearer's article of clothing, such as jeans 16. The jewelry item 10 may be attached to anything having a suitable attachment point that allows the jewelry item 10 to hang under the force of gravity, such as a door knob, a cabinet handle, a vehicle's rearview mirror, a wire shelf, a purse, and others. Most typically, the jewelry item 10 may be attached to an article of clothing having a belt loop or belt loop type feature, such as jeans, pants, slacks, shorts, skirts, dresses, overalls, and others. However, it will become apparent to those skilled in the art after seeing the jewelry item of the present invention, that it may be attached to various different types and kinds of attachment points such as other portions of wearing apparel, body piercing, stationary objects, and others.

The jewelry item 10 may include an attachment portion 18 and a decorative portion 21. The attachment portion 18 may include the fastening device 12, a ring 23 for attaching the decorative portion 21 to the attachment portion 18, and a swivel device 25 for connecting the fastening device 12 to the ring 23. The fastening device 12 may include a hook 27 having an upper generally U-shaped section 29 for quick and easy attachment and removal from an attachment point, such as a belt loop or other similar feature, and a lower connection section 32 having an eyelet (not shown) for attachment to an upper loop 36 of the swivel device 25, either directly by inserting the upper loop 36 through the eyelet in the connection section 32 as shown or by using a fastener (not shown), such as a wire ring or the like, to attach the eyelet to the upper loop. The upper U-shaped section 29 of the fastening device 12 may also include an eyelet 41 at its end for attaching a decorative article 43.

The swivel device 25 may be any suitable device capable of allowing rotation between the fastening device 12 and the ring 23 for permitting different views of the decorative portion 21 of the jewelry item 10 to be presented while hanging from its desired attachment point. A lower loop 45 of the swivel device 25 may be attached to the ring 23, either directly by looping the ring 23 through the lower loop 45 as shown or by using a fastener (not shown), such as wire ring or the like, to attach the ring to the lower loop.

The decorative portion 21 of the jewelry item 10 may include a linear chain 49 and a plurality of decorative articles, such as decorative articles 52, 54, removably attached to the chain 49, either directly as shown or by using fasteners (not shown), such as wire rings or the like. The chain 49 may include a plurality of links, such as links 56, 58, being of sufficient size to allow easy attachment and removal of the decorative articles. One or more of the decorative articles may be attached to each of the links of the chain 49 to provide a dense cluster or conglomeration of the decorative articles. Individual decorative articles may be added to the chain or may be removed from the chain and replaced with different decorative articles to modify the appearance of the jewelry item. Likewise, the entire set of the decorative articles may be removed from the chain and replaced with an entirely different set of decorative articles to completely change the appearance of the jewelry item. The length of the chain may be of a suitable length such as between about 6 inches and about 1 foot.

A first end of the chain 49 may be fixedly attached to the ring 23 either by looping the end link 61 of the chain 49 directly through the ring 23 or by using a fastener (not shown), such as a wire ring of the like, to attach the end link 61 at the first end of the chain to the ring 23. The other end of the chain 49 may include a fastening device 63 attached thereto. The fastening device 63 may be a lobster clasp or other suitable releasable fastening device that can be releasably attached to the ring 23 as shown in FIG. 2 or to one of the links of the chain 49, such as link 65, as shown in FIG. 3 to reduce the length of the decorative portion 21 and to consolidate and increase the density of the decorative articles to change the aesthetics of the jewelry item 10. A large/heavy decorative article 67 (FIG. 2) may be attached approximately at the middle link 66 of the chain 49 to weigh down the decorative portion 21 of the jewelry item 10 when the fastening device 63 is attached to the ring 23 so that the doubled over chain 49 is properly extended and the decorative articles are aesthetically displayed.

Figure 4:
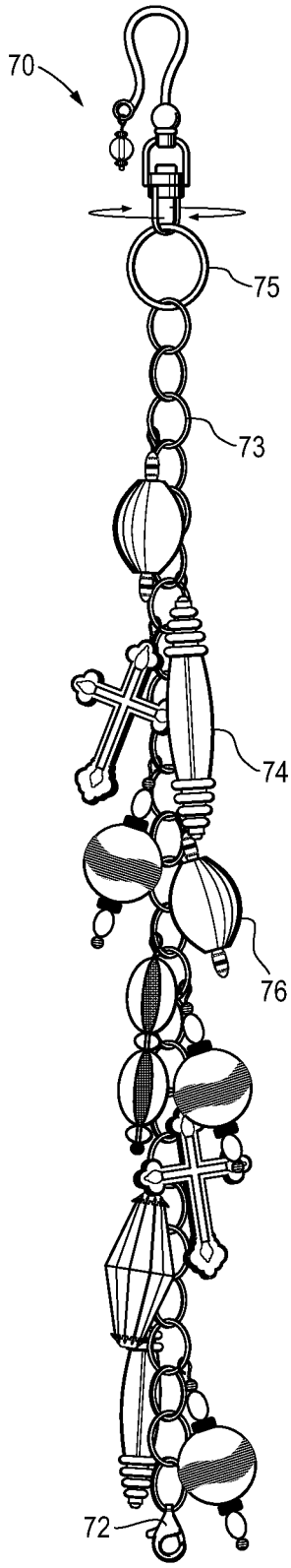
FIG. 4 is a front pictorial view of another embodiment of the jewelry item constructed according to the present invention illustrated with its chain fully extended.

Referring now to FIG. 4, another embodiment of the jewelry item according to the present invention is shown and generally referenced as 70. The jewelry item 70 may be substantially identical to the jewelry item 10 described above, except that it includes fewer decorative articles, such as decorative articles 74 and 76, removably attached to the chain 73, and that the fastening device 72 may not be attached to either the ring 75 or one of the links of the chain 73 allowing the chain 73 to hang fully extended to provide another aesthetically pleasing look for the wearer.

Figure 5:
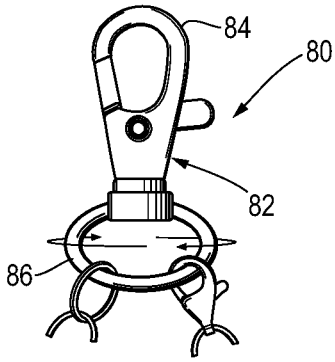
FIG. 5 is a fragmentary view of still another embodiment of the jewelry item constructed according to the present invention.

Referring now to FIG. 5, still another embodiment of the jewelry item according to the present invention is partially shown and generally referenced as 80. The jewelry item 80 may be substantially identical to the jewelry item 10 described above, except that an attachment portion 82 replaces previously described attachment portion 18. The attachment portion 82 may be an all-in-one device incorporating a latching fastening device 84, such as a lobster clasp or other suitable latching fastening device, and a ring 86 rotatably attached to the fastening device.

The method of making a jewelry item for hanging from an attachment point, such as a belt loop or other suitable hanging point, may include selecting the desired type of fastening devices, swivel device, linear chain, and decorative articles to make the jewelry item. A first fastening device for attaching to the attachment point may be attached to a first side of a swivel device either directly or using a fastener, such as a wire ring. Next, a ring may be attached to a second side of the swivel device either directly or using a fastener, such as a wire ring. A first end of the linear chain may then be attached to the ring either by looping the end link at the first end of the chain directly through the ring or by using a fastener, such as a wire ring, to attach the end link at the first end of the chain to the ring. A second fastening device suitable for releasably attaching to the ring or the links of the chain may be fixedly attached to the end link at a second end of the linear chain. A plurality of decorative articles may then be removably attached to the links of the linear chain to provide the jewelry item with a very dense conglomeration of decorative articles. A large decorative article, such as one that may be larger than the other decorative articles, may be attached to a link at approximately the midpoint of the chain to assist with the proper extension of the chain in its doubled over configuration, such as when the second fastening device is attached to the ring.

The first fastening device may allow a user to quickly and removably attach the jewelry item to the belt loop. The second fastening device may allow a user to adjust the length of the jewelry item by releasably attaching the second fastening device to the ring or one of the links of the chain to form a loop of chain. The swivel and/or ring may be integrally connected to the first fastening device.

In use, the user of the jewelry items as described above may attach the first fastening device of the jewelry item to an attachment point for permitting the jewelry item to hang under the force of gravity, and then attach the second fastening device to the ring to form a loop of chain so that the decorative articles cluster together under the force of gravity to form an aesthetically pleasing conglomeration thereby substantially concealing the chain from view.

Alternatively, the user may detach the second fastening device from the ring, and then attach the second fastening device to one of the links of the chain to form a linear region of the chain and a looped region of the chain so that the decorative articles align together in the linear region and cluster together in the looped region under the force of gravity to form an aesthetically pleasing linear configuration and conglomeration at the end of the linear configuration.

Alternatively, the user may detach the second fastening device from the one of the links of the chain for permitting the chain to extend to its full length so that the decorative articles align together under the force of gravity to form an aesthetically pleasing linear configuration.

In any of the alternative uses described above, the user may rotate the chain of the jewelry item to expose a different view of the decorative items. The user may also detach one to the whole set of the decorative articles attached to the chain of the jewelry item and replace them with one to a whole set of different decorative articles to slightly to significantly modify the appearance of the jewelry item.

Words such as "about," "approximately" or other such words as used herein shall be defined to mean a tolerance of plus or minus 20 percent.

While particular embodiments of the present invention have been disclosed, it is to be understood that various different modifications are passing and one contemplated within the true spirit and scope of the appended claims. For example, attachment and/or decorative portions could be composed of a variety of materials, such as metal, plastic, and other. Also, it will become apparent that a variety of different types and kinds of fastening devices may be employed, including, but not limited to, hooks, clasps, clips, pins, carabiner, and others. There is no intention, therefore, of limitations to the exact abstract or disclosure herein presented.

What is claimed is:

1. A method of using a jewelry item, the method comprising:

providing the jewelry item, the jewelry item comprising:

a first fastening device for quickly attaching and releasing the jewelry item from a belt loop on clothing worn by a user, said first fastening device including an open hook for suspending the jewelry item from the belt loop to enable the jewelry item to hang flat against the body of the user;

a chain with a plurality of links and having a first end and a second end, the first end of the chain being coupled to the hook;

a plurality of decorative articles removably individually attached to substantially all of the links of the chain;

the dimension of each one of the links of the chain being substantially less than the dimension of each decorative element for substantially concealing the chain from view;

a swivel device being coupled between the open hook and the first end of the chain for permitting the chain to rotate relative to the open hook to expose a different view of the decorative articles;

a top ring being connected between the swivel and the first end of the chain; and a second fastening device in the form of a lobster clasp being connected to the second end of the chain for releasably and selectively linking with the ring or alternatively linking with a desired individual one of the links of the chain to form a closed loop of chain so that the length of the jewelry item can be adjusted;

attaching the open hook to the belt loop on the clothing worn by the user for permitting the jewelry item to hang under the force of gravity flat against the body of the user;

linking releasably the lobster clasp with the top ring to form a loop of chain so that the decorative articles cluster together under the force of gravity to form an aesthetically pleasing conglomeration thereby substantially concealing the chain from view;

detaching the second fastening device from the ring;

linking releasably the lobster clasp with a desired individual one of the links of the chain to form a linear region of the chain and a looped region of the chain so that the decorative articles align together in the linear region and cluster together in the looped region under the force of gravity to form an aesthetically pleasing linear configuration and conglomeration at the end of the linear configuration;

detaching the lobster clasp from being linked with one of the links of the chain for permitting the chain to extend to its full length so that the decorative articles align together under the force of gravity to form an aesthetically pleasing linear configuration;

rotating the chain using the swivel device to expose a different view of the decorative articles;

detaching at least one of the decorative articles; and attaching at least one different decorative article to modify the appearance of the jewelry item.

2. The method according to claim 1, wherein the first fastening device is integrally connected to the swivel device and the ring.

3. The method according to claim 1, wherein the first fastening device includes an eyelet for attaching a decorative article.

4. The method according to claim 1, further including attaching a large decorative article to approximately the middle link of the chain.

5. The method according to claim 1, further including attaching a decorative article to an eyelet in the first fastening device.

* * * * *